US005129465A

United States Patent [19]

Rahm

[11] Patent Number: 5,129,465

[45] Date of Patent: Jul. 14, 1992

[54] SCREW TIGHTENING POWER TOOL

[75] Inventor: Erik R. Rahm, Upplands Väsby, Sweden

[73] Assignee: Atlas Copco Tools AB, Stockholm, Sweden

[21] Appl. No.: 498,835

[22] Filed: Mar. 26, 1990

[30] Foreign Application Priority Data

Mar. 28, 1989 [SE] Sweden ..... 8901072

[51] Int. Cl.[5] ..... B25B 23/14

[52] U.S. Cl. ..... 173/178; 192/150; 81/470; 81/474

[58] Field of Search ..... 173/12; 192/56 R, 150; 81/470, 474

[56] References Cited

U.S. PATENT DOCUMENTS

| | | | |
|---|---|---|---|
| 3,195,704 | 7/1965 | Linsker | 192/150 |
| 3,237,742 | 3/1966 | Ulbing | 192/150 |
| 3,515,251 | 6/1970 | Clapp | 173/12 X |
| 3,766,990 | 10/1973 | Eckman et al. | 173/12 |
| 4,071,092 | 1/1978 | Wallace | 173/12 |
| 4,154,308 | 5/1979 | Goldsberry et al. | 173/12 |
| 4,191,282 | 3/1980 | Schoeps | 192/150 X |
| 4,429,775 | 2/1984 | Teramoto | 173/12 X |

*Primary Examiner*—Douglas D. Watts
*Assistant Examiner*—Rinaldi Rada
*Attorney, Agent, or Firm*—Frishauf, Holtz, Goodman & Woodward

[57] ABSTRACT

A screw tightening power tool, comprising a rotation motor, a power supply (27) connected to the motor, an output shaft (13), a torque responsive release clutch (14) including a driving half (16) and a driven half (17) and coupling the motor to the output shaft (13), an activating rod (26) coupled to the power supply (27), a latch means (24) associated with one of the clutch halves (16) and cooperating with the activating rod (26), and a cam (30) associated with the other of the clutch halves (17) and operatively connected to the latch (24) for making the latch shift from an activating rod (26) supporting position to an activating rod (26) releasing position as the transferred torque has reached the actual preset release torque level of the clutch. The cam (30) comprises a spindle (30) which is rotatively supported relative to the driven clutch half (17) for a limited rotational movement relative thereto.

11 Claims, 1 Drawing Sheet

SCREW TIGHTENING POWER TOOL

BACKGROUND OF THE INVENTION

The invention relates to a screw tightening power tool which comprises a rotation motor, a power supply means connected to the motor, an output shaft, a torque responsive release clutch including a driving half and a driven half and coupling the motor to the output shaft, an activating rod coupled to the power supply means, a latch means associated with one of the clutch halves and cooperating with the activating rod, and a cam means associated with the other of the clutch halves and operatively connected to the latch means for making the latter shift from an activating rod supporting position to an activating rod releasing position as the transferred torque has reached the actual preset release torque level of the clutch.

A primary object of the invention is to accomplish an improved shut-off initiating mechanism in a power tool of the above related type.

The problem to be solved by the invention is to avoid the undesirable influence of the cam mechanism on the torque load acting on the release clutch. In a previous power tool of the above type, the friction forces developed by the cam means acting on the latch means adds an undesireable, non-constant load on the release clutch. That resulted in a scattered output torque from the tool.

In U.S. Pat. No. 3,766,990, there is described an automatic screwdriver in which the shut-off initiating cam means is of the rotating type formed in one piece with the driven clutch half. By that arrangement, the friction forces developed by the cam means and loading the release clutch are reduced to some extent. Still, the cam means of this known tool is arranged to perform its shut-off initiating action on the latch simultaneously with the cam lobes of the clutch reaching their maximum torque transferring positions. This means that the maximum torque transferred by the clutch is determined both by the clutch itself and by the friction forces developed by the shut-off initiating cam means. In U.S. Pat. No. 4,154,308 there is shown a screw driving tool of the same type as in U.S. Pat. No. 3,766,990 with the difference that the shut-off initiating cam means comprises a cam apex that is sidewise displaced. The purpose thereof is to delay the shut-off initiating movement of the latch until the clutch balls have passed the apex of the cam lobes so as to avoid a situation where the latch is locked on top of one of the apexes and, thereby, blocks reopening of the air supply valve. By this delayed cam-latch engagement, however, the friction forces developed between the latch and the shut-off initiating cam means are prevented from adding to the maximum torque set on the release clutch. This auxiliary effect, which is not recognized in the specification of U.S. Pat. No. 4,154,308, is obtained in one direction of rotation only.

The above problem is overcome by the invention as it is defined in the claims.

DETAILED DESCRIPTION

Figure 2:
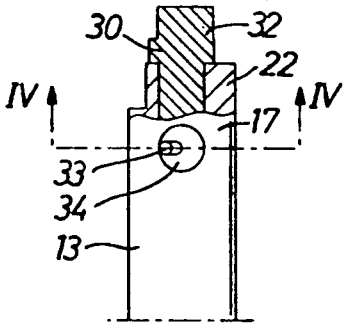
FIG. 2 shows a side view of the output shaft and cam spindle of the power tool in FIG. 1.

The screw tightening power tool shown on the drawing comprises a housing 10 in which is mounted a pneumatic vane motor (not shown) which communicates with a central pressure air supply passage 11 and an exhaust passage 12 in the housing 10. The vane motor is coupled to an output shaft 13 via a torque responsive release clutch 14. The latter comprises a driving half 16, a driven half 17, and three torque transmitting balls 18 which are biassed radially inwardly by a spring 20 and a conical ring 19. The driven clutch half 17 is formed in one piece with the output shaft 13. The pretension of the spring 20 is adjustable to set the release torque level of the clutch 14. At its rear end, the output shaft 13 is formed with three equally spaced cam lobes 22 (see FIG. 2) for engagement with the balls 18. Since the balls 18 are rotationally locked relative to the driving clutch half 16 by being supported in radial pockets in the latter (not shown), torque transferred by the clutch makes the cam lobes 22 of the driven clutch half urge the balls 18 outwardly against the bias pressure of spring 20. This clutch is prior art and is, therefore, not described in further detail.

In a transverse bore 23 in the driving clutch half 16, there is movably supported a latch 24 which is biassed by a spring 25 toward a left hand position. See FIG. 1. In this position the latch 24 supports an axially extending activating rod 26 which is associated with a throttle valve 27 located in the pressure air supply passage 11. In a previously known way, the latch 24 has an opening 29 which when brought into alignment with the activating rod 26 receives the lower end of the latter, thereby making the throttle valve 27 close.

Figure 1:
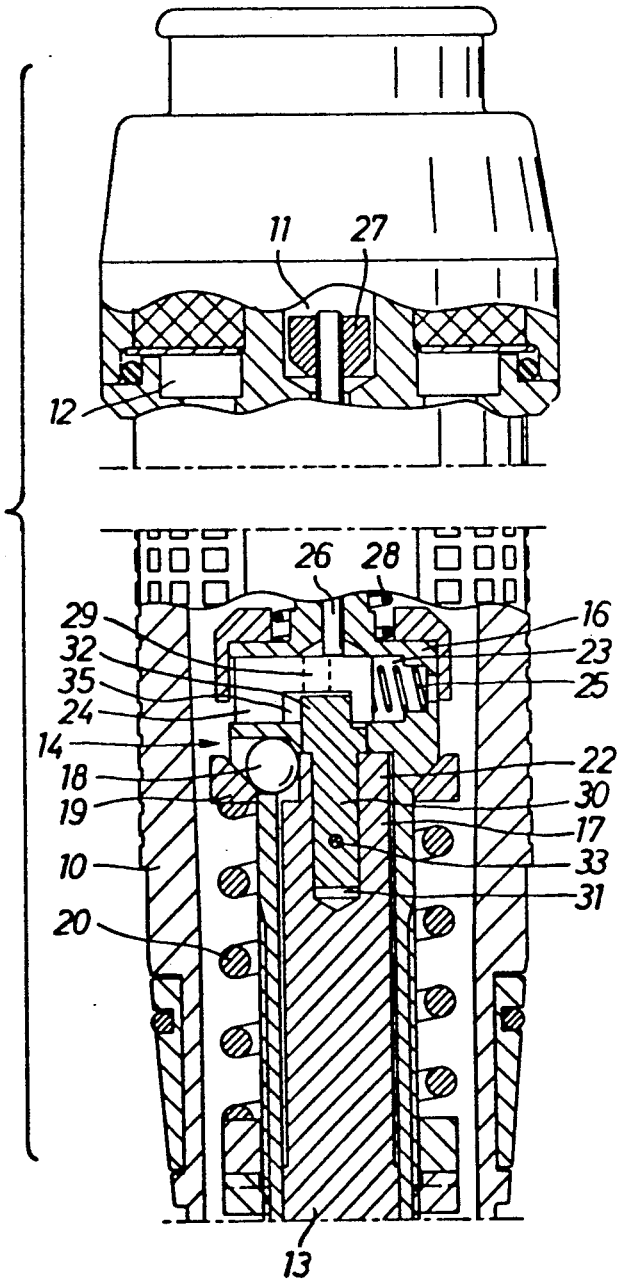
FIG. 1 shows a fractional longitudinal section through a power tool according to one embodiment of the invention.

The above-described tool has a so called push start arrangement, which means that when the tool is applied onto a screw joint to be tightened and an axial force is exerted on the tool housing towards the joint, the output shaft 13 as well as the entire clutch 14 and the activation rod 26 are displaced backwards relative to the housing 10 against the action of the spring 28. This results in an opening movement of the throttle valve 27 and a starting of the motor. A condition for the throttle valve to open is that the latch 24 occupies its inactivated position, as illustrated in FIG. 1.

Figure 4:
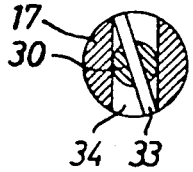
FIG. 4 shows a cross section along line IV—IV in FIG. 2.

For shifting the latch 24 from its left hand activating rod 26 supporting position to an activating rod 26 releasing position, there is provided a cam spindle 30 which is supported in a central bore 31 in the rear end of the output shaft 13. The cam spindle 30 is formed with three equally spaced cam lobes 32 for engagement with the latch 24. For that purpose, the latch 24 is formed with an aperture 35 in which the uppermost can lobe 32 portion of the spindle 30 is received. As a rotational movement between the spindle 30 and the latch 24 occurs, the cam lobes 32, one at a time, will act on the right hand side wall of the aperture 35 to displace the latch 24 to the right, thereby bringing the opening 29 into alignment with the activation rod 26 to initiate shut-off of throttle valve 27. A transverse pin 33 is rigidly attached to the cam spindle 30 for locking the latter against rotation relative to the output shaft 13. The pin 33 cooperates with two diametrically opposite apertures 34 in the output shaft 13. These apertures 34, however, have a diameter that considerably exceeds the diameter of the pin 33 and that provides for a rotational play between the cam spindle 30 and the output shaft 13. See FIG. 4.

Figure 3:
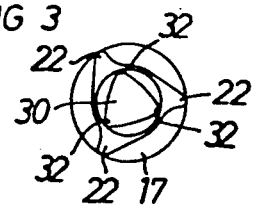
FIG. 3 shows an end view of the cam spindle shown in FIG. 2.

As can be seen in FIG. 3, the cam lobes 32 of the cam spindle 30 are located at substantially the same angular positions as the cam lobes 22 of the driven clutch half 13, which means that the latch 24 is activated at about the time the clutch 14 reaches its release position, i.e. when the balls 18 are about to pass over the apexes of the cam lobes 22.

The rotational play provided by the difference in diameter between the transverse pin 33 and the apertures 34 is effective in accomplishing a delay in the activation of the latch 24 and, thereby, a delay in the closing of the throttle valve 27. This delay ensures that the cam activation of the latch 24 does not take place until the clutch 14 has passed its release point in which the desired maximum torque is delivered, i.e. when the balls 18 have just passed over the apexes of the cam lobes 22. By this arrangement, the frictional resistance, although small, developed between the cam spindle 30 and the latch 24 will have no influence upon the critical maximum torque transferred by the clutch 14.

The delay in releasing the activation rod 26 and closing the throttle valve 27 is effective also to ensure that the pressure air supply to the motor is not shut-off before the clutch 14 has reached its predetermined release torque level.

The two apertures 34 in the output shaft 13 are so located as to ensure a rotational play between the cam spindle 30 and the output shaft 13 on both sides of a center position in which the angular position of the cam lobes 32 are exactly the same as that of the cam lobes 22 of the clutch 14. This means that there is provided a delay in the latch engagement in both directions of rotation. Hence, there is obtained the same advantage as regards the avoidance of premature shut-off in whichever direction of rotation of the tool.

Restart of the motor is obtained by lifting the tool off the joint being tightened, whereby the spring 28 displaces the clutch 14 and the output shaft 13 forwards resulting in seating of valve 27 and a withdrawal of the rod 26 from the opening 29 in the latch 24. Then, the latter is permitted to regain its inactivated position by the action of spring 25 to be able to axially support the rod 26 as another push start movement is made.

I claim:

1. A screw tightening power comprising:

a rotation motor;

a power supply means (27) connected to said motor for selectively supplying a pressure fluid for driving said motor, and said power supply means (27) being shiftable between an open position for supplying pressure fluid to said motor and a closed position;

an output shaft (13);

a torque responsive release clutch (14) including a driving clutch half (16) and a driven clutch half (17) each having a given number of first coupling means (18, 22) providing a corresponding number of alternative relative engagement positions between said clutch halves (16, 17), and which in said alternative relative engagement positions couple said motor to said output shaft (13);

an activating rod (26) coupled to said power supply means (27) and being axially movable between a supported position, which is a power supply means (27) activating position, and a released position, which is a power supply means (27) inactivating position;

latch means (24) associated with one of said clutch halves (16) and shiftable between an activating rod (26) supporting position and an activating rod (26) releasing position; and cam means (32) associated with the other of said clutch halves (17) and operatively connected to said latch means (24) for making said latch means (24) shift from said activating rod (26) supporting position to said activating rod (26) releasing position as transferred torque reaches a preset release torque level of said clutch (14);

said cam means (32) comprising a cam spindle (30) which is rotatively supported relative to said other of said clutch halves (17) and drivingly connected to said other of said clutch halves (17) by a second coupling means (33, 34) which provides for a limited angular freedom of said cam means (32) relative said other of said clutch halves (17);

said other of said clutch halves (17) comprising a central bore (31) in which said cam spindle (30) is received;

said second coupling means (33, 34) including means for drivingly connecting said cam spindle (30) to said other of said clutch halves (16, 17) under the provision of said limited angular freedom of said cam means (32); and wherein said cam spindle (30) comprises cam lobes (32) of a number corresponding to the number of relative engagement positions of said clutch halves (16, 17), and said cam lobes (32) are arranged to act upon said latch means (24) each time said clutch halves (16, 17) leave their relative engagement positions as the predetermined release torque level is reached.

2. The power tool of claim 1, wherein said one of said clutch halves (17) comprises the driving clutch half (16), and said other of said clutch halves (16, 17) comprises the driven clutch half (17).

3. The power tool of claim 1, wherein said coupling means (33, 34) comprises a transverse pin (33) which is rigidly attached to said cam spindle (30) and which extends into diametrically opposite apertures (34) in said other of said clutch halves (16, 17), said apertures (34) having a diameter exceeding a diameter of said pin (33) to provide for said limited rotational movement.

4. The power tool of claim 3, wherein said apertures (34) are located so as to provide for a rotational play by means of which is accomplished a delay in activation of the latch means (24) in both opposite directions of rotation of the tool.

5. The power tool of claim 4, wherein said latch means comprises a radially movable latch member (24) which is spring biassed towards its activating rod (26) supporting position and which is formed with an aperture (29) to receive an end portion of said activating rod (26) when shifted into alignment with said activating rod (26) by said cam means of said cam spindle (30).

6. The power tool of claim 3, wherein said latch means comprises a radially movable latch member (24) which is spring biased towards its activating rod (26) supporting position and which is formed with an aperture (29) to receive an end portion of said activating rod (26) when shifted into alignment with said activating rod (26) by said cam means of said cam spindle (30).

7. The power tool of claim 1, wherein said limited rotational movement between said cam spindle (30) and said other of said clutch halves (17) provides for a delay in the latch means (24) shifting operation by said cam means (30), such that said latch means (24) is shifted after said clutch halves (16, 17) have left their relative engagement positions.

8. The power tool of claim 7, wherein said latch means comprises a radially movable latch member (24) which is spring biased towards its activating rod (26) supporting position and which is formed with an aperture (29) to receive an end portion of said activating rod (26) when shifted into alignment with said activating rod (26) by said cam means of said cam spindle (30).

9. The power tool of claim 1, wherein said latch means comprises a radially movable latch member (24) which is spring biased towards its activating rod (26) supporting position and which is formed with an aperture (29) to receive an end portion of said activating rod (26) when shifted into alignment with said activating rod (26) by said cam means of said cam spindle (30).

10. A screw tightening power tool, comprising:

a rotation motor;

a power supply means (27) connected to said motor for selectively supplying a pressure fluid for driving said motor, and said power supply means (27) being shiftable between an open position for supplying pressure fluid to said motor and a closed position;

an output shaft (13);

a torque responsive release clutch (14) including a driving clutch half (16) and a driven clutch half (17) each having a given number of first coupling means (18, 22) providing a corresponding number of alternative relative engagement positions between said clutch halves (16, 17), and which in said alternative relative engagement positions couple said motor to said output shaft (13);

an activating rod (26) coupled to said power supply means (27) and being axially movable between a supported position, which is a power supply means (27) activating position, and a released position, which is a power supply means (27) inactivating position;

latch means (24) associated with one of said clutch halves (16) and shiftable between an activating rod (26) supporting position and an activating rod (26) releasing position; and cam means (32) associated with the other of said clutch halves (17) and operatively connected to said latch means (24) for making said latch means (24) shift from said activating rod (26) supporting position to said activating rod (26) releasing position as transferred torque reaches a preset release torque level of said clutch (14);

said cam means (32) comprising a cam spindle (30) which is rotatively supported relative to said other of said clutch halves (17) and drivingly connected to said other of said clutch halves (17) by a second coupling means (33, 34) which provides for a limited angular freedom of said cam means (32) relative said other of said clutch halves (17);

said other of said clutch halves (17) comprising a central bore (31) in which said cam spindle (30) is received;

said one of said clutch halves (17) comprising the driving clutch half (16), and said other of said clutch halves (16, 17), comprising the driven clutch half (17); and said latch means comprising a radially movable latch member (14) which is spring biassed towards its activating rod (26) supporting position and which is formed with an aperture (29) to receive an end portion of said activating rod (26) when shifted into alignment with said activating rod (26) by said cam means of said cam spindle (30).

11. A screw tightening power tool, comprising:

a rotation motor;

a power supply means (27) connected to said motor for selectively supplying a pressure fluid for driving said motor, and said power supply means (27) being shiftable between an open position for supplying pressure fluid to said motor and a closed position;

an output shaft (13);

a torque responsive release clutch (14) including a driving clutch half (16) and a driven clutch half (17) each having a given number of first coupling means (18, 22) providing a corresponding number of alternative relative engagement positions between said clutch halves (16, 17), and which in said alternative relative engagement positions couple said motor to said output shaft (13);

an activating rod (26) coupled to said power supply means (27) and being axially movable between a supported position, which is a power supply means (27) activating position, and a released position, which is a power supply means (27) inactivating position;

latch means (24) associated with one of said clutch halves (16) and shiftable between an activating rod (26) supporting position and an activating rod (26) releasing position; and cam means (32) associated with the other of said clutch halves (17) and operatively connected to said latch means (24) for making said latch means (24) shift from said activating rod (26) supporting position to said activating rod (26) releasing position as transferred torque reaches a preset release torque level of said clutch (14);

said cam means (32) comprising a cam spindle (30) which is rotatively supported relative to said other of said clutch halves (17) and drivingly connected to said other of said clutch halves (17) by a second coupling means (33, 34) which provides for a limited angular freedom of said cam means (32) relative said other of said clutch halves (17);

said one of said clutch halves (17) comprising the driving clutch half (16), and said other of said clutch halves (16, 17) comprising the driven clutch half (17); and said latch means comprising a radially movable latch member (24) which is spring biassed towards its activating rod (26) supporting position and which is formed with an aperture (29) to receive an end portion of said activating rod (26) when shifted into alignment with said activating rod (26) by said cam means of said cam spindle (30).

* * * * *

UNITED STATES PATENT AND TRADEMARK OFFICE

CERTIFICATE OF CORRECTION

PATENT NO. : 5,129,465

DATED : July 14, 1992

INVENTOR(S) : Erik R. RAHM

It is certified that error appears in the above-identified patent and that said Letters Patent is hereby corrected as shown below:

Column 3, line 49 (Claim 1):

After "power", insert --tool,--.

Signed and Sealed this

Twelfth Day of October, 1993

*Attest:*

*Attesting Officer*

BRUCE LEHMAN

*Commissioner of Patents and Trademarks*